United States Patent [19]

Hall

[11] 4,266,312

[45] May 12, 1981

[54] APPARATUS FOR USE IN LAMINATING A WORKPIECE

[75] Inventor: Dennis S. Hall, Leicester, England

[73] Assignee: USM Corporation, Farmington, Conn.

[21] Appl. No.: 53,098

[22] Filed: Jun. 28, 1979

[30] Foreign Application Priority Data

Aug. 19, 1978 [GB] United Kingdom ..... 33950/78

[51] Int. Cl.[3] ..... A43D 11/00; A43D 95/00

[52] U.S. Cl. ..... 12/52; 12/54.2; 12/54.3; 12/146 C

[58] Field of Search ..... 12/52, 54.2, 54.3, 53.5, 12/21, 33.2, 146 C

[56] References Cited

U.S. PATENT DOCUMENTS

| | | | |
|---|---|---|---|
| 1,195,965 | 8/1916 | Brock | 12/54.2 |
| 2,484,876 | 10/1949 | Dodge | 12/54.2 |
| 3,440,672 | 4/1969 | Fromantin | 12/54.3 X |
| 3,445,873 | 5/1969 | Staden | 12/54.2 X |

FOREIGN PATENT DOCUMENTS

| | | | |
|---|---|---|---|
| 2068754 | 9/1971 | France | 12/53.5 |
| 615983 | 1/1949 | United Kingdom . | |
| 1103051 | 2/1968 | United Kingdom . | |
| 1149235 | 4/1969 | United Kingdom . | |
| 1327768 | 8/1973 | United Kingdom . | |

*Primary Examiner*—James Kee Chi

*Attorney, Agent, or Firm*—Owen J. Meegan; Carl E. Johnson

[57] ABSTRACT

Equipment for laminating for a shoe upper and a lining through the use of an interposed adhesive layer including a form having portions of different radius of curvatures and two operating side surfaces including a heater and two pressers which sequentially engage the workpiece and shape it to correspond with the form.

7 Claims, 3 Drawing Figures

APPARATUS FOR USE IN LAMINATING A WORKPIECE

BACKGROUND OF THE INVENTION

This invention concerns apparatus for use in laminating a workpiece and is especially concerned with apparatus which is suitable for use in laminating a workpiece which comprises a shoe upper or a portion of a shoe upper, a lining therefor, and a layer of adhesive therebetween.

SUMMARY OF THE PRIOR ART

In the shoe industry, shoe uppers are laminated with linings therefor by pressing the upper and its lining between two planar platens of a press while applying heat to activate adhesive between the upper and its lining. This method has the disadvantage that, when the upper and the lining are formed into the shape which they adopt in the finished shoe, either the lining must stretch relative to the upper or vice a versa and this creates undesirable creases in the finished shoe. It is possible to laminate an upper and its lining by pressing them between a die which has the shape of a last for the finished shoe and a complementary die so that they will adopt the shape they have in the finished shoe but, hitherto, this method has required the provision of a range of different pairs of dies for different styles and sizes of upper so that considerable expense has been involved.

SUMMARY OF THE INVENTION

It is an object of the present invention to provide an apparatus suitable for use in laminating a workpiece which comprises a shoe upper or a portion of a shoe upper, a lining therefor, and a layer of adhesive therebetween, which apparatus shapes the upper and its lining to approximately the shape they have in the finished shoe and can operate on a range of sizes and shapes of upper without requiring the use of different dies.

There is hereinafter described in detail to illustrate the invention an apparatus which is suitable for use in laminating a workpiece which comprises a shoe upper or a portion of a shoe upper, a lining therefor and a layer of adhesive therebetween. The illustrative apparatus comprises a form made of aluminium on which a workpiece can be positioned for laminating, and heating means in the form of cartridge heaters operable to heat a workpiece positioned on the form. The form has an upper surface which has portions of different radius of curvature along its length and which surface is engaged by a central portion of a workpiece when the workpiece is positioned on the form. The portions of different radius of curvature allow an operator of the illustrative apparatus to select the portion which has the most appropriate radius of curvature on which to position the workpiece. For ease of manufacture, the portions of different radius of curvature are provided by a series of arcuate sections.

The form of the illustrative apparatus also has two opposite side surfaces each of which is generally planar and inclined to the vertical so that the form tapers upwards. The planar side surfaces enable an operator of the illustrative apparatus to position a workpiece accurately on the upper surface of the form and to stretch the workpiece across the upper surface to remove creases therefrom prior to the lamination of the workpiece. Because of the planar side surfaces, an operator of the illustrative apparatus can so position a workpiece without contacting the form with his hands (which is undesirable because the form is heated). Furthermore, the planar side surfaces of the form allow edge portions of the workpiece to be pressed against the form by simple pressing means of the illustrative apparatus.

The pressing means of the illustrative apparatus comprises a first presser member made of silicone rubber having a surface generally complementary to the upper surface of the form. First moving means of the pressing means in the form of a piston and cylinder assembly is operable to move the first presser member into an operative position in which it presses the central portion of a workpiece positioned on the form against the upper surface of the form. The pressing means also comprises two generally planar presser members, one associated with each of the side surfaces of the form, and second moving means, in the form of a piston and cylinder assembly, operable, after operation of the first moving means, to move the presser members so that they press edge portions of a workpiece positioned on the form against opposite side surfaces of the form.

The invention provides an apparatus suitable for use in laminating a workpiece which comprises a shoe upper or a portion of a shoe upper, a lining therefor, and a layer of adhesive therebetween, the apparatus comprising a form on which a workpiece can be positioned for laminating, heating means operable to heat a workpiece positioned on the form, and pressing means operable to press a workpiece positioned on the form against the form, the form having an upper surface which has portions of different radius of curvature along its length and which surface is engaged by a central portion of a workpiece when the workpiece is positioned on the form, and two opposite side surfaces each of which is generally planar and inclined to the vertical so that the form tapers upwardly, and the pressing means comprising a first presser member having a surface generally complementary to the upper surface of the form, first moving means operable to move the first presser member into an operative position in which it presses the central portion of a workpiece positioned on the form against the upper surface of the form, two generally planar presser members one associated with each of the side surfaces of the form, and second moving means operable, after operation of the first moving means, to move the presser members so that they press edge portions of a workpiece positioned on the form against the opposite side surfaces of the form.

Preferably, in an apparatus as set out in the last preceding paragraph, the upper surface of the form has a concave portion against which an instep region of a workpiece can be positioned to be pressed against the form.

There now follows a detailed description, to be read with reference to the accompanying drawings, of the illustrative apparatus aforementioned. The illustrative apparatus has been selected for description to illustrate the invention by way of example.

DESCRIPTION OF THE PREFERRED EMBODIMENT

Figure 1:
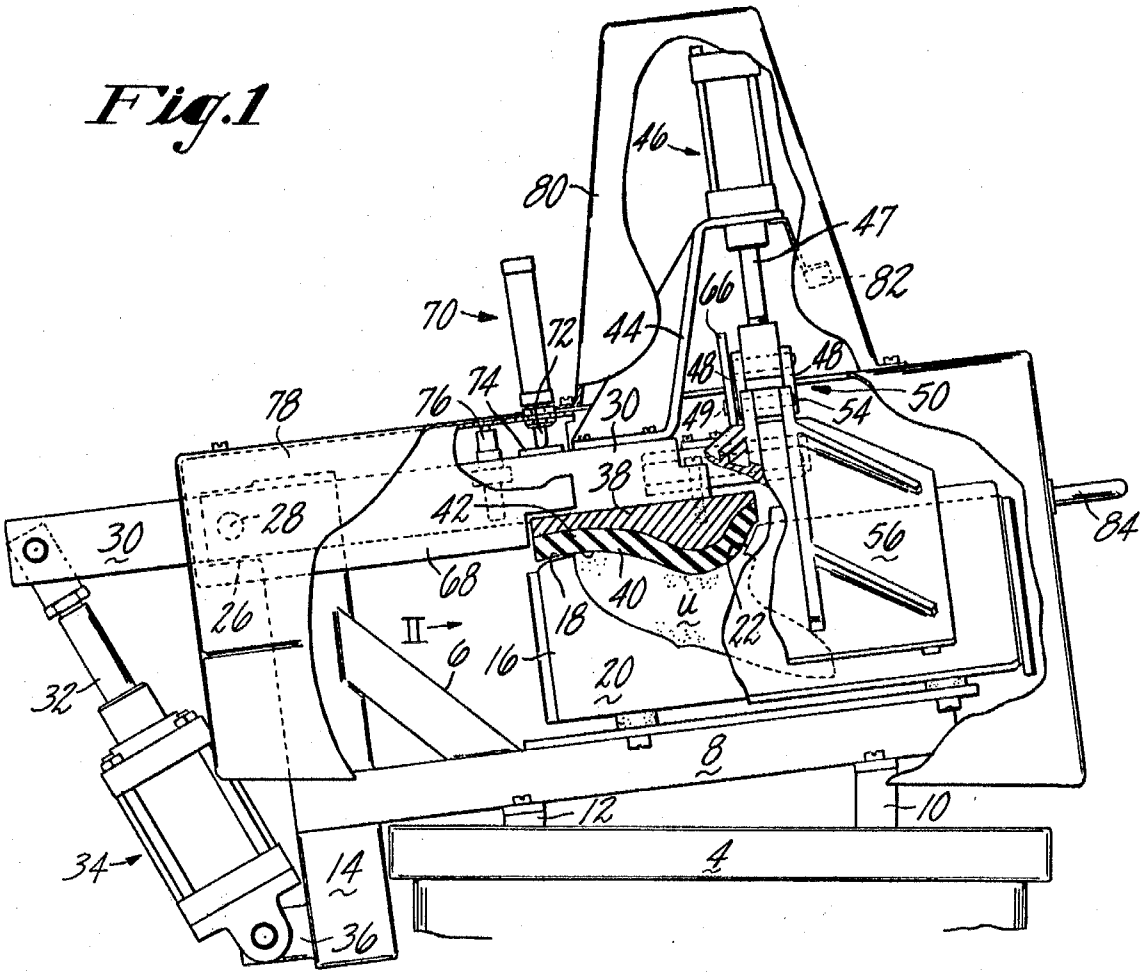
FIG. 1 is a side elevational view, partly in section, of the illustrative apparatus.

The illustrative apparatus shown in the drawings is suitable for use in laminating a workpiece which comprises a shoe upper or a portion of a shoe upper, a lining therefor, and a layer of adhesive therebetween. The illustrative apparatus comprises a table 4 which supports a framework 6 of the apparatus. The framework 6 comprises a support plate 8 mounted on the table 4 on a forward block 10 and a rearward block 12. The forward block 10 is of greater height than the rearward block 12 so that the support 8 is inclined downwardly and rearwardly. The framework 6 also comprises a strut 14 which extends normally to the support plate 8 at a rearward portion thereof.

Figure 2:
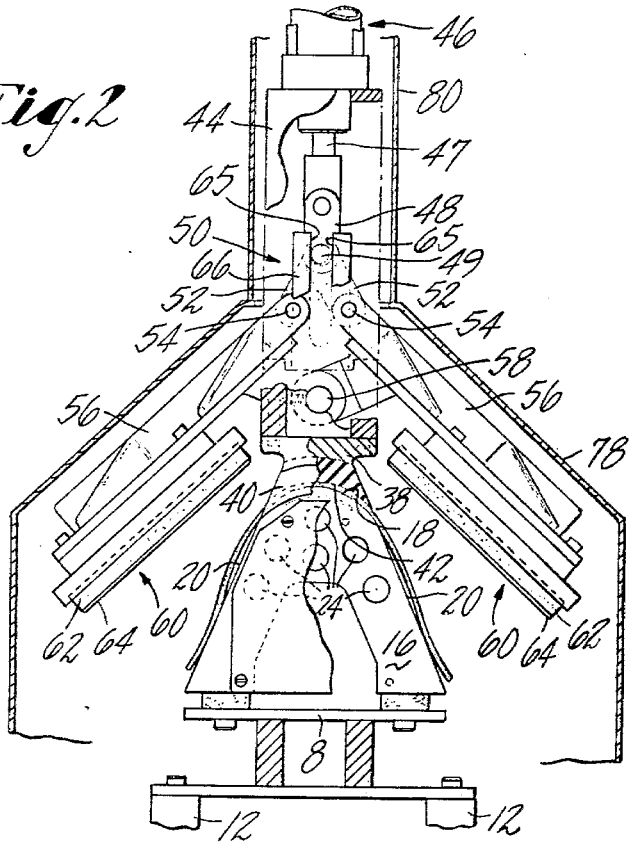
FIG. 2 is a sectional view taken in the direction of the arrow II in FIG. 1.
Figure 3:
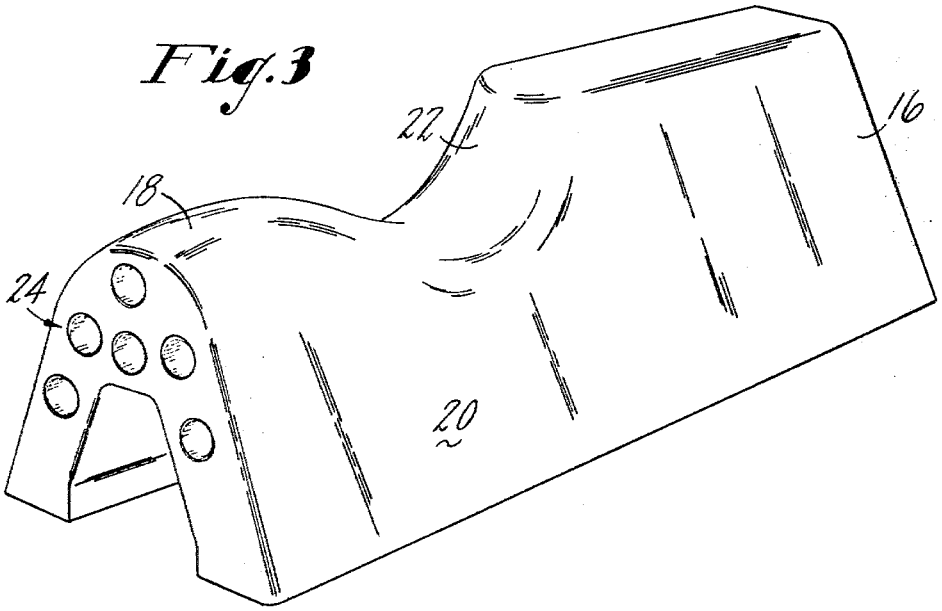
FIG. 3 is a perspective view of a form of an illustrative apparatus.

Mounted on the support plate 8 is a form 16 of the illustrative apparatus on which a workpiece can be positioned for laminating. The form 16 is made of aluminium and has an upper surface 18 which has portions of different radius of curvature along the length of the form (see FIGS. 1 and 3). The surface 18 is engaged by a central portion of a workpiece U when the workpiece is positioned on the form 16 (FIG. 1). The portions of different radius of curvature of the upper surface 18 of the form 16 are provided by a series of arcuate sections (one of which is visible in FIG. 2) which sections are successive along the length of the form and blend one into the other. The form 16 also has two opposite side surfaces 20 each of which is generally planar and inclined to the vertical so that the form 16 tapers upwardly (see FIGS. 2 and 3). The surfaces 20 are coterminous with the upper surface 18 but extend rearwardly further than the surface 18 (see FIG. 1). The upper surface 18 has a concave portion 22 (see FIG. 1) against which an instep region of the workpiece U can be positioned to be pressed against the form 16. The form 16 contains bores in which cartridge heaters 24 (see FIG. 2) are located. The cartridge heaters 24 provide heating means of the illustrative apparatus operable to heat the workpiece U positioned the form 16 so that the adhesive of the workpiece is activated to laminate the workpiece.

At an upper end portion thereof, the strut 14 carries a lug 26 which supports an axle 28 which extends transversely of the illustrative apparatus. A lever member 30 is pivotally mounted on the axle 28 and extends forwardly and rearwardly of the strut 14. The rearward end portion of the lever member 30 is pivotally connected to the piston 32 of a piston and cylinder assembly 34 which is pivotally mounted on a lug 36 supported by a lower end portion of the strut 14. Operation of the piston and cylinder assembly 34 is effective to pivot the lever member 30 is a vertical plane about the axial 28. A forward end portion of the lever 30 carries a support 38 on which is mounted a first presser member 40 of pressing means of the illustrative apparatus.

The first presser member 40 has a lower surface 42 which is opposed to the surface 18 of the form 16. The surface 42 is generally complementary to the surface 18 (including the concave portion 22 thereof). The first presser member 40 is made of silicone rubber so that it is unaffected by the heat applied to the form 16 by the heaters 24. The piston and cylinder asssembly 34 provides first moving means of the pressing means of the illustrative apparatus and is operable to move the presser member 40 by pivoting the lever member 30 about the axle 28. The first presser member 40 is pivoted into an operative position in which it presses a central portion of a workpiece U positioned on the form 16 against the upper surface 18 of the form 16 (this position is shown in FIG. 1) and an out-of-the-way position in which a workpiece U can be positioned on the form 16.

A bracket 44 is mounted on the upper side of the lever member 30 at a forward end portion thereof and extends upwardly from the lever member 30. The bracket 44 supports a piston and cylinder assembly 46 the piston 47 of which is connected by means of two links 48 to the central pin 49 of a toggle arrangement 50. The toggle arrangement 50 (see FIG. 2) comprises the central pin 49, two pairs of links 52, and two end pins 54. Each of the end pins 54 is pivotally connected to an upper portion of a support plate 56. The two support plates 56 are pivotally mounted on a stub shaft 58 which extends from the forward end of the strut 30 and is supported thereby. The support plates 56 depend one on each side of the form 16 (see FIG. 2) and each carries a generally planar presser member 60 of the pressing means of the illustrative apparatus. Each presser member 60 is associated with one of the side surfaces 20 of the form 16 and comprises a resilient pad 62 with a surface layer of silicone rubber 64.

The piston and cylinder assembly 46 forms second moving means of the pressing means of the illustrative apparatus and is operable, after operation of the piston and cylinder assembly 34, to move the presser members 60 so that they press edge portions of a workpiece positioned on the form 16 against the opposite side surfaces 20. To bring the presser members 60 into engagement with the workpiece, the piston 47 moves downwardly to bring the toggle arrangement 50 to a straightened condition. To move the presser members 60 away from the surfaces 20, the piston 47 moves upwardly to break the toggle (see FIG. 2). The movement of the toggle arrangement 50 is guided by an extension of the central pin 49 which slides in a vertical slot 65 in a bracket 66 mounted on top of the lever member 30.

A central portion of the lever member 30 is enclosed by a box member 68 which is pivotally mounted on the axle 28. The box member 68 carries a piston and cylinder assembly 70 which has a piston 72 which engages a bearing plate 74 mounted on top of the lever member 30. Operation of the piston and cylinder assembly 70 is effective to pivot the box member 68 about the axle 28 (anticlockwise in FIG. 1). A switch 76 is mounted on top of the lever member 30 to be operated by engagement therewith by the box member 68. A guard 78 is also pivotally mounted on the axle 28. The guard 78 is pivotable about the axle 28 between an operative position thereof (shown in FIG. 1) in which it surrounds the form 16 and an out-of-the-way position in which an operator has access to the form 16. The guard 78 has an upward extension 80 which surrounds the piston and cylinder assembly 46 and its movement relative to the lever member 30 is limited by a stop 82 mounted on the bracket 44. The guard 78 can be moved relative to the lever member 30 by means of a handle 84 mounted on a front surface of the guard 78.

At the beginning of an operation of the illustrative apparatus, the assembly 34 operates pivoting the lever member 30 about the axle 28 (anticlockwise in FIG. 1). This movement raises the guard 78 and the presser members 60 clear of the form 16 allowing access to the form 16. The assembly 70 operates raising the guard 78 relative to the lever member 30 into engagement with the stop 82. An operator of the apparatus can now position a workpiece U on the form 16. He does this by holding the workpiece by edge portions thereof and stretching the workpiece over the upper surface 18 of the form 16. He engages the central portion of the workpiece U with the portion of the surface 18 which has the most appropriate radius of curvature so that the workpiece will be laminated in approximately the shape which it will adopt in the finished shoe. The surfaces 20 of the form 16 do not obstruct the positioning of the workpiece U since they are generally planar and the operator can avoid contacting his hands with these surfaces. Once in contact with the form 16 the workpiece U is subjected to heat from the form 16 supplied by the cartridge heaters 24. This heat activates adhesive of the workpiece to cause lamination thereof. When he has positioned the workpiece U, the operator of the illustrative apparatus causes the piston and cylinder assembly 34 to operate pivoting the lever member 30 about the axle 28 (clockwise in FIG. 2) so that the first presser member 40 engages the workpiece U in the central portion thereof which is in position on the surface 18 of the form 16. The movement of the lever member 30 also moves the presser members 60 into a position in which they overlie the surfaces 20 and edge portions of the workpiece U. The workpiece U is now clamped against the form 16 by the presser member 40. The guard 78 now partially encloses the form 16 but is held out of its operative position by the assembly 70. The operator thus still has access to the edge portions of the workpiece U. The operator now moves the guard into its operative position by means of the handle 84, to do this he moves the guard 78 and box member 68 against the force applied by the assembly 70. When the guard 78 reaches its operative position, the box member 68 engages the switch 76 which causes operation of the piston and cylinder assembly 46. The piston and cylinder assembly 46 operates straightening the toggle arrangement 50 and pivoting the presser members 60 about the stub shaft 58 and thereby causes the presser members 60 to engage edge portions of the workpiece U and press them against the surfaces 20 of the form 16. When the workpiece U has been pressed against the form 16 for a sufficient time to allow the workpiece to become laminated, the operator releases the guard 78 and the piston and cylinder assemblies 34 and 46 reverse their operation raising the presser members 40 and 60 away form the workpiece U and raising the guard 78 to its out-of-the-way position so that the operator can remove the workpiece U.

I claim:

1. Apparatus for laminating a workpiece including at least a portion of a shoe upper and a lining through the use of an interposed layer of adhesive, said apparatus comprising:

a form for positioning the workpiece, said form having an upper surface which has portions of different radius of curvature along its length and two opposite side surfaces, each of which is generally planar and inclined to the vertical so that the form tapers upwardly;

means to heat the workpiece;

pressing means operable to press the workpiece positioned on the form, said pressing means including a first presser member having a surface generally complementary to the upper surface of the form, and two generally planar second presser members, one associated with each of the side surfaces of the form;

first moving means operable to move the first presser member into an operative position in which it presses the central portion of the workpiece against the upper surface of the form, and second moving means operable with the second presser members, arranged to index after operation of the first moving means to move the second presser members so that they press the edge portions of the workpiece disposed on the form against the opposite side surfaces of the form.

2. An apparatus according to claim 1 wherein the upper surface of the form has a concave portion against which an instep region of a workpiece can be positioned to be pressed against the form.

3. An apparatus according to claims 1 or 2 wherein the portions of different radius of curvature of the upper surface of the form are provided by series of arcuate sections.

4. An apparatus according to claims 1 or 2 wherein the first presser member is made of silicone rubber.

5. An apparatus according to claims 1 or 2 wherein the generally planar presser members each comprises a resilient pad with a surface layer of silicone rubber.

6. An apparatus according to claims 1 or 2 wherein the second moving means is caused to operate by movement of a guard to a position in which it surrounds the form.

7. An apparatus according to claims 1 or 2 wherein the form is made of aluminum.

* * * * *